US006758073B2

(12) United States Patent
Yu

(10) Patent No.: US 6,758,073 B2
(45) Date of Patent: Jul. 6, 2004

(54) LOCK ASSEMBLY

(76) Inventor: Shih-Szu Yu, 18409 Hawthorne Ave., Bloomington, CA (US) 92316

( * ) Notice: Subject to any disclaimer, the term of this patent is extended or adjusted under 35 U.S.C. 154(b) by 0 days.

(21) Appl. No.: 10/216,134

(22) Filed: Aug. 12, 2002

(65) Prior Publication Data

US 2004/0025552 A1 Feb. 12, 2004

(51) Int. Cl.[7] ..... E05B 27/06

(52) U.S. Cl. ..... 70/358; 70/419; 70/423; 70/454; 70/493

(58) Field of Search ..... 70/358, 375, 490, 70/492, 493, 419, 401, 407, 409, 420, 421, 423, 424, 427, 428, 454, 455

(56) References Cited

U.S. PATENT DOCUMENTS 1,407,267 A * 2/1922 Hacklander ..... 70/358 X
1,438,336 A * 12/1922 Schroeder ..... 70/493
1,892,419 A * 12/1932 Best ..... 70/419 X
4,044,578 A * 8/1977 Guiraud ..... 70/401 X
4,104,898 A * 8/1978 Fois ..... 70/419
4,446,709 A * 5/1984 Steinbach ..... 70/419 X
4,490,998 A * 1/1985 Wellekens ..... 70/419
5,148,690 A * 9/1992 Wang ..... 70/419 X
5,475,997 A * 12/1995 Chung ..... 70/375
5,718,137 A * 2/1998 Huston ..... 70/423
5,758,526 A * 6/1998 Gorokhovsky ..... 70/375
5,987,940 A * 11/1999 Chang ..... 70/358 X
6,058,752 A * 5/2000 Feder ..... 70/419
6,059,326 A * 5/2000 Tramontina ..... 70/422 X
6,272,890 B1 * 8/2001 Huston ..... 70/423
6,386,006 B1 * 5/2002 DeWalch ..... 70/454 X
6,550,298 B1 * 4/2003 Su ..... 70/455 X

* cited by examiner

*Primary Examiner*—Suzanne Dino Barrett
(74) *Attorney, Agent, or Firm*—Raymonddy. Chan David and Raymond Patent Group

(57) ABSTRACT

A lock assembly includes a lock cylinder, for actuating a latch assembly, including a lock sleeve, first and second lock rotors, having first and second keyways respectively, rototably fitted in the lock sleeve, and a plurality of tumblers for locking up the first and second lock rotors. A key includes a key head having predetermined locking serrations arranged in such a manner that when the key head is inserted into the first keyway, the locking serrations are adapted to unlock the first lock rotor and enable the first lock rotor freely rotating until the first keyway is aligned with the second keyway, simultaneously, the key head being adapted to insert into the second keyway such that the locking serrations are adapted to unlock the second lock rotor to enable the second lock rotor to freely rotate to control the locking and unlocking of the latch assembly.

3 Claims, 10 Drawing Sheets

LOCK ASSEMBLY

FIELD OF THE PRESENT INVENTION

The present invention relates to lock and key, and more particularly to a lock assembly comprising a lock cylinder, having a multiple locking permutations, associated with a key to provide more locking permutations and combinations so as to ensure the security function of the lock assembly.

BACKGROUND OF THE PRESENT INVENTION

The conventional lock and key assembly, such as barrel lock, utilizes specific engagement or disengagement between a plurality of pin-tumblers in the locking cylinder and the key's serrations correspondingly to control the locking and unlocking functions thereof.

Virtually, all mechanical locking devices are subject to tempering, possibly resulting from loss of keys, duplication of keys, and picking due to its limited mechanical structure and theory. Thus, one of the major drawbacks of the conventional locking assembly is that the pin-tumblers of such conventional lock assembly can be seen through the lock cylinder such that the pin-tumblers can respectively be pressed in order to unlock the lock assembly. In addition, the easiest way to unlock the lock assembly is to destroy all the pin-tumblers of the lock assembly. Therefore, the see-though lock cylinder of the lock assembly cannot ensure the security function thereof.

Moreover, the serrations of the key may be repeatedly duplicated such that the key can open several locks by fully inserting the key into the lock cylinder or just half way of the lock cylinder to match the pin-tumblers thereof.

For security purpose, an electronic lock assembly having a predetermined cipher preset therein is provided recently. However, the electronic lock assembly is too expensive to install since it must be incorporated with a computer such that the electronic lock assembly cannot be popular in used. Thus, the electronic lock assembly can be easily unlocked by someone hacks in the computer or by decoding the cipher.

SUMMARY OF THE PRESENT INVENTION

A main object of the present invention is to provide a lock assembly which comprises a lock cylinder associated with a key, wherein the lock cylinder comprises at least two lock rotors having different locking permutations in such a manner that the key must fit to unlock the lock rotors in order to unlock the lock assembly. Therefore, the lock assembly can provide more locking permutations and combinations so as to ensure the security function of the lock assembly.

Another object of the present invention is to provide a lock assembly, wherein the lock cylinder further comprises a protective rotor coaxially positioned in front of the lock rotor such that the tumblers of the lock rotor cannot be seen through the opening of the lock cylinder, so as to further ensure the security function of the lock assembly. Therefore, the present invention can prevent the lock assembly from being intentionally unlocked by any tools through a keyway thereof.

Another object of the present invention is to provide a lock assembly which avoids the drawbacks of easy picking and key duplicating of the conventional mechanical lock and key assembly by eliminating the serrations of the keys to associate with the mechanical lock cylinder by fitting into the keyway thereof.

Another object of the present invention is to provide a lock assembly, wherein in order to unlock the lock assembly, the serrations of the key must match both the lock rotors for disengaging the tumblers thereof with respect to the lock cylinder. Therefore, even though the serrations of the key match the first lock rotor, the lock assembly cannot be opened without matching another lock rotor.

Another object of the present invention is to provide a lock assembly, wherein the arrangement of the tumblers, which is not limited to one or two opposing rows as in the mechanical lock and key assembly, can include any possible number of tumblers aligned around anywhere of the entire cylindrical surfaces of the key and keyways correspondingly, so that the present invention can provide more locking permutations and combinations to ensure the security function of the lock assembly.

Accordingly, in order to accomplish the above objects, the present invention provides a lock assembly, comprising:

- a lock cylinder for actuating a latch assembly wherein the lock cylinder comprises:
  - a lock sleeve having an axial rotor hole and a plurality of first and second tumbler sockets radially distributed on an inner surface of the lock sleeve;
  - a plurality of tumblers being coaxially placed in the first and second tumbler sockets respectively;
- a lock rotor assembly, comprising:
  - a first lock rotor, having a tubular shaped, being rotatably and coaxially fitted in the axial rotor hole of the lock sleeve to define a first keyway therethrough, the first lock rotor having a plurality of first locking holes radially distributed on an outer circumferential surface of the first lock rotor, wherein each of the first locking holes is capable of coaxially aligning with the first tumbler sockets respectively;
  - a second lock rotor, having a tubular shaped, being rotatably and coaxially fitted in the axial rotor hole of the lock sleeve to define a second keyway therethrough wherein the second keyway is normally misaligned with the first keyway, the second lock rotor having a plurality of second locking holes radially distributed on an outer circumferential surface of the second lock rotor, wherein each of the first locking holes is capable of coaxially aligning with the second tumbler sockets respectively; and
- a plurality of lock pins being coaxially placed in the first and second locking holes respectively; and
- a plurality of resilient elements being coaxially disposed in the first and second tumbler sockets respectively for applying urging pressures on the tumblers to move inwardly towards the first and second locking holes until an inner portion of each of the tumblers is disposed in the respective first and second locking hole and an outer portion of the tumbler is disposed in the respective first and second tumbler socket so as to lock up the rotational movements of the first and second lock rotors within the lock sleeve; and
- a key comprising a key head having predetermined locking serrations arranged in such a manner that when the key head is inserted into the first keyway, the locking serrations of the key head are adapted to drive the lock pins to pull the tumblers moving outwardly into the first tumbler sockets correspondingly to unlock the first lock rotor and enable the first lock rotor freely rotating until the first keyway is aligned with the second keyway, simultaneously, the key head being adapted to insert into the second keyway such that the locking serrations of the key head are adapted to drive the lock pins to pull the tumblers moving outwardly into the second tumbler sockets correspondingly so as to unlock the second lock rotor to enable the second lock rotor to freely rotate to control the locking and unlocking of the latch assembly.

DETAILED DESCRIPTION OF THE PREFERRED EMBODIMENT

Figure 1:
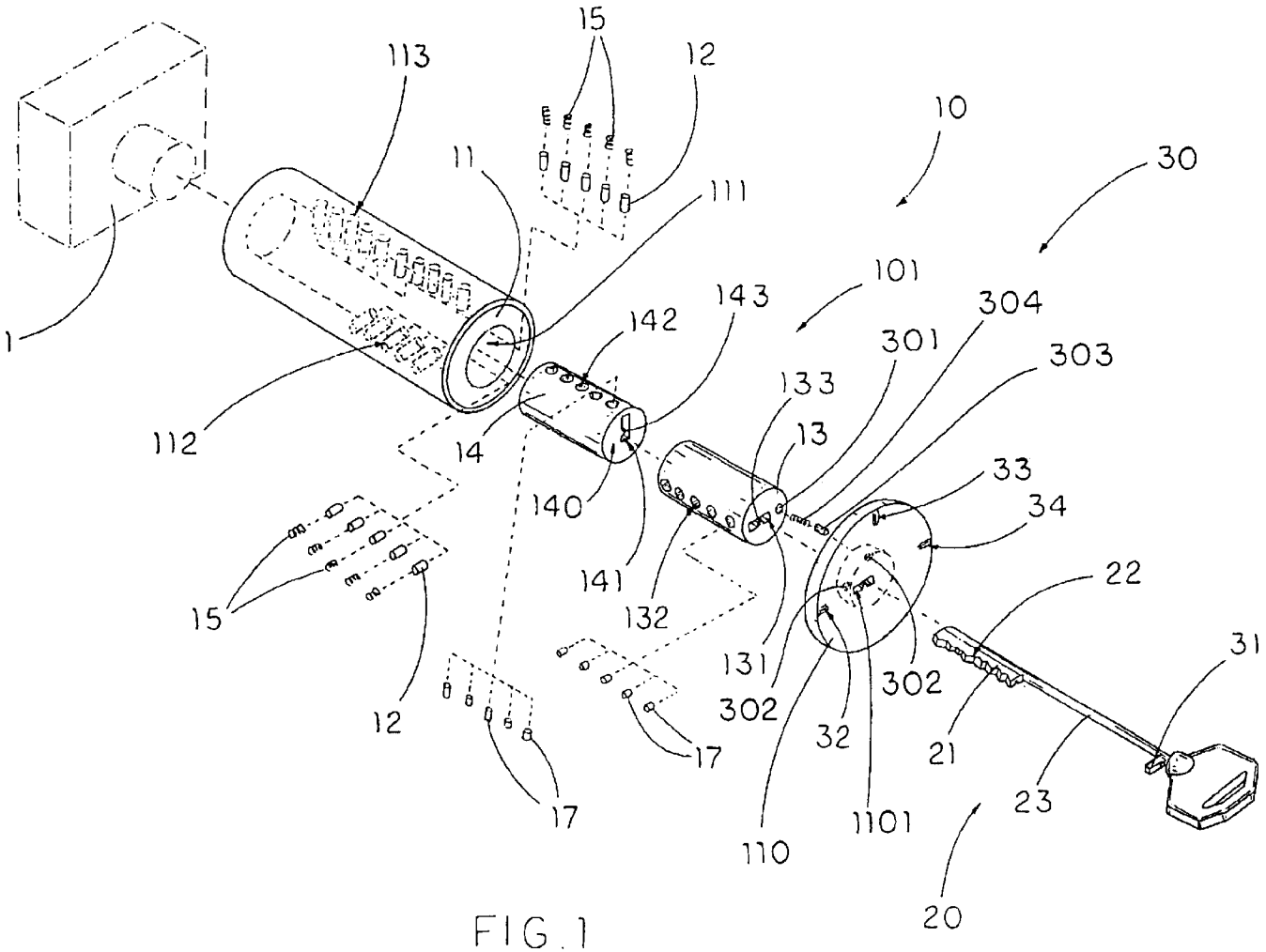
FIG. 1 is an exploded perspective view of a lock assembly according to a first preferred embodiment of the present invention.
Figure 2:
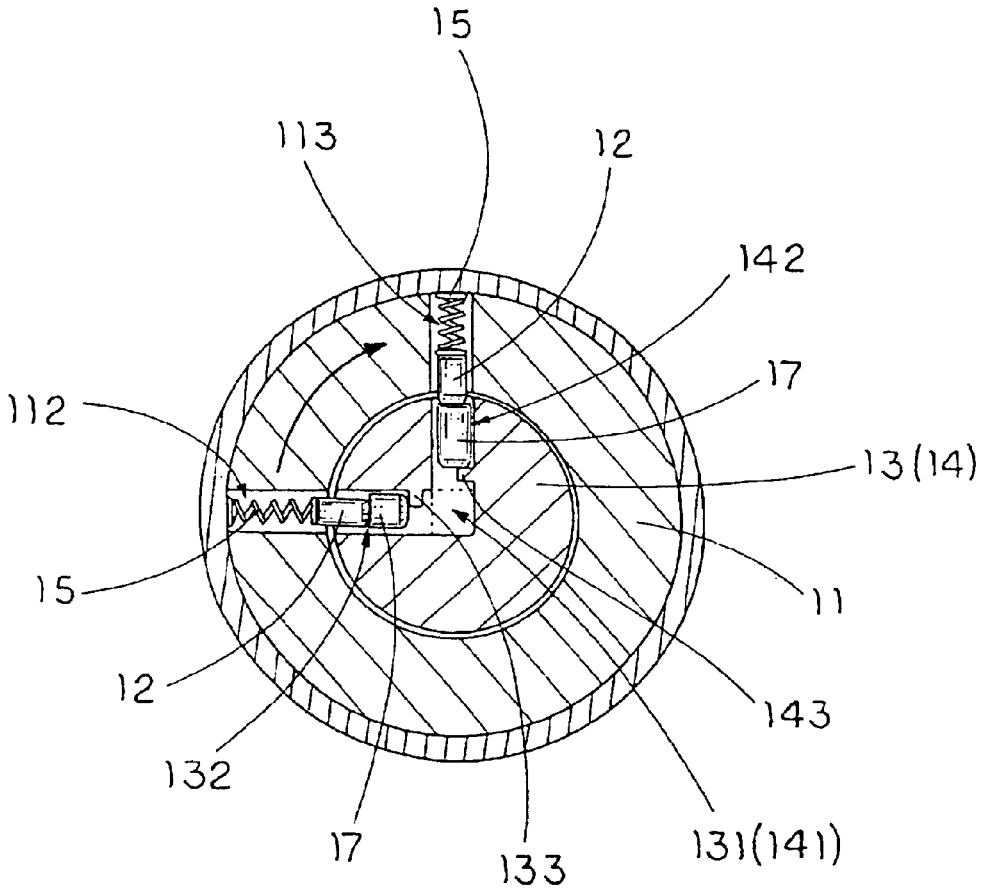
FIG. 2 is a sectional view of the lock assembly according to the above first preferred embodiment of the present invention.

Referring to FIGS. 1 and 2 of the drawings, a lock assembly according to a first preferred embodiment is illustrated, wherein the locking assembly comprises a lock cylinder 10 for actuating a latch assembly 1 and a key 20.

The lock cylinder 10, which is preferably made of metal such as stainless steel, comprises lock sleeve 11, a plurality of tumblers 12, a lock rotor assembly 101, and a plurality of resilient elements 15.

The lock sleeve 11 has an axial rotor hole 111 and a plurality of first and second tumbler sockets 112, 113 radially distributed on an inner surface of the lock sleeve 11. The tumblers 12 are coaxially placed in the first and second tumbler sockets 112, 113 of the lock sleeve 11 respectively, wherein each of the tumblers 12 must be equal to or shorter than the respective first and second tumbler sockets 112, 113 of the lock sleeve 11.

The lock rotor assembly 101 comprises a first lock rotor 13, a second lock rotor 1514, and a plurality of lock pins 17. The first lock rotor 13, having a tubular shaped, is rotatably and coaxially fitted in the axial rotor hole 111 of the lock sleeve 11 to define a first keyway 131 therethrough. The first lock rotor 13 has a plurality of first locking holes 132 radially distributed on an outer circumferential surface of the first lock rotor 13, wherein each of the first locking holes 132 is capable of coaxially aligning with the first tumbler sockets 112 respectively. Accordingly, the first keyway 131 is radially extended from a center of the first lock rotor 13.

The second lock rotor 14, having a tubular shaped, is rotatably and coaxially fitted in the axial rotor hole 111 of the lock sleeve 11 to define a second keyway 141 therethrough wherein the second keyway 141 is normally misaligned with the first keyway 131 so as to block up an arrangement of the tumblers 12 within the first locking holes 132 of the first lock rotor 13. The second lock rotor 14 has a plurality of second locking holes 142 radially distributed on an outer circumferential surface of the second lock rotor 14, wherein each of the first locking holes 142 is capable of coaxially aligning with the second tumbler sockets 113 respectively. Accordingly, the second keyway 141 is radially extended from a center of the second lock rotor 14.

The lock pins 17 are coaxially placed in the first and second locking holes 132, 142 respectively, wherein the lock pins 17 are preferred to have different heights so as to provide a unique locking permutation of the lock assembly.

Accordingly, each of the first and second lock rotors 13, 14 further has a pin seat 133, 143 provided in each of the first and second locking holes 132, 142 such that the lock pins 17 can only sit on the pin seats 133, 142 within the first and second locking holes 132, 142 respectively without sliding into the first and second keyways 131, 141 respectively.

The resilient elements 15, which are compression springs according to the preferred embodiment, are coaxially disposed in the first and second tumbler sockets 112, 113 respectively for applying urging pressures on the tumblers 12 to move inwardly towards the first and second locking holes 132, 142 until an inner portion of each of the tumblers 12 is disposed in the respective first and second locking hole 132, 142 and an outer portion of the tumbler 12 is disposed in the respective first and second tumbler socket 112, 113 so as to lock up the rotational movements of the first and second lock rotors 13, 14 within the lock sleeve 11.

The lock cylinder 10 further comprises a lock cover 110 coaxially mounted on an entrance of the axial rotor hole 111 of the lock sleeve 11 to retain the lock rotor assembly 101 within the lock sleeve 11, wherein the lock cover 110 has a key access slot 1101, having a predetermined length, coaxially formed thereon wherein the key access slot 1101 is normally aligned with the first keyway 131 of the first lock rotor 13 in such a manner that the key 20 is adapted to insert into the first keyway 131 through the key access slot 1101. Accordingly, the first lock rotor 13 is blocked by the lock cover 110, so as to prevent the first and second lock rotors 13, 14 from sliding out from the axial rotor hole 111 of the lock sleeve 11.

Moreover, the locking combinations of the lock pins 17 within the first lock rotor 13 is blocked by the lock cover 110 such that the lock pins 17 within the first lock rotor 13 cannot be seen through the key access slot 1101, so as to prevent the second lock rotor 14 being accessed by another key 20 that does not match to unlock the lock assembly. It is worth mentioning that since the first rotor lock 13 is blocked by the lock cover 110, the key access slot 1101 increases the difficulty of reaching the first rotor lock by inserting a wrong key into the key access slot 1101.

The key 20 comprises a key head 21 having predetermined locking serrations 22 arranged in such a manner that when the key head 21 is inserted into the first keyway 131 through the key access slot 1101 of the lock cover 110, the locking serrations 22 of the key head 21 are adapted to drive the lock pins 17 to pull the tumblers 12 moving outwardly into the first tumbler sockets 112 correspondingly to unlock the first lock rotor 13 and enable the first lock rotor 14 freely rotating until the first keyway 131 is aligned with the second keyway 141, simultaneously, the key head 21 being adapted to insert into the second keyway 141 such that the locking serrations 22 of the key head 21 are adapted to drive the respective lock pins 17 to pull the tumblers 12 moving outwardly into the second tumbler sockets 113 correspondingly so as to unlock the second lock rotor 14 to enable the second lock rotor 14 to freely rotate to control the locking and unlocking of the latch assembly 1.

It is worth mentioning that the locking and unlocking operation of the latch assembly 1 is actuated by the second lock rotor 14. In other words, the second lock rotor must be driven to rotate to control the locking and unlocking of the latch assembly 1. However, the first lock rotor 13 must be unlocked firstly in order to unlock the second lock rotor 14. Therefore, a user must use the corresponding key 20 to unlock both the first and second lock rotors 13, 14 for unlocking the latch assembly 1. Moreover, the second keyway 141 is normally blocked by the first lock rotor 13 that the arrangement of the tumblers 12 within the second lock rotor 14 cannot be seen through the first keyway 131, such that even through the first lock rotor 13 is intentionally broken, the latch assembly 1 cannot be unlocked so as to ensure the security function of the lock assembly.

Figure 3:
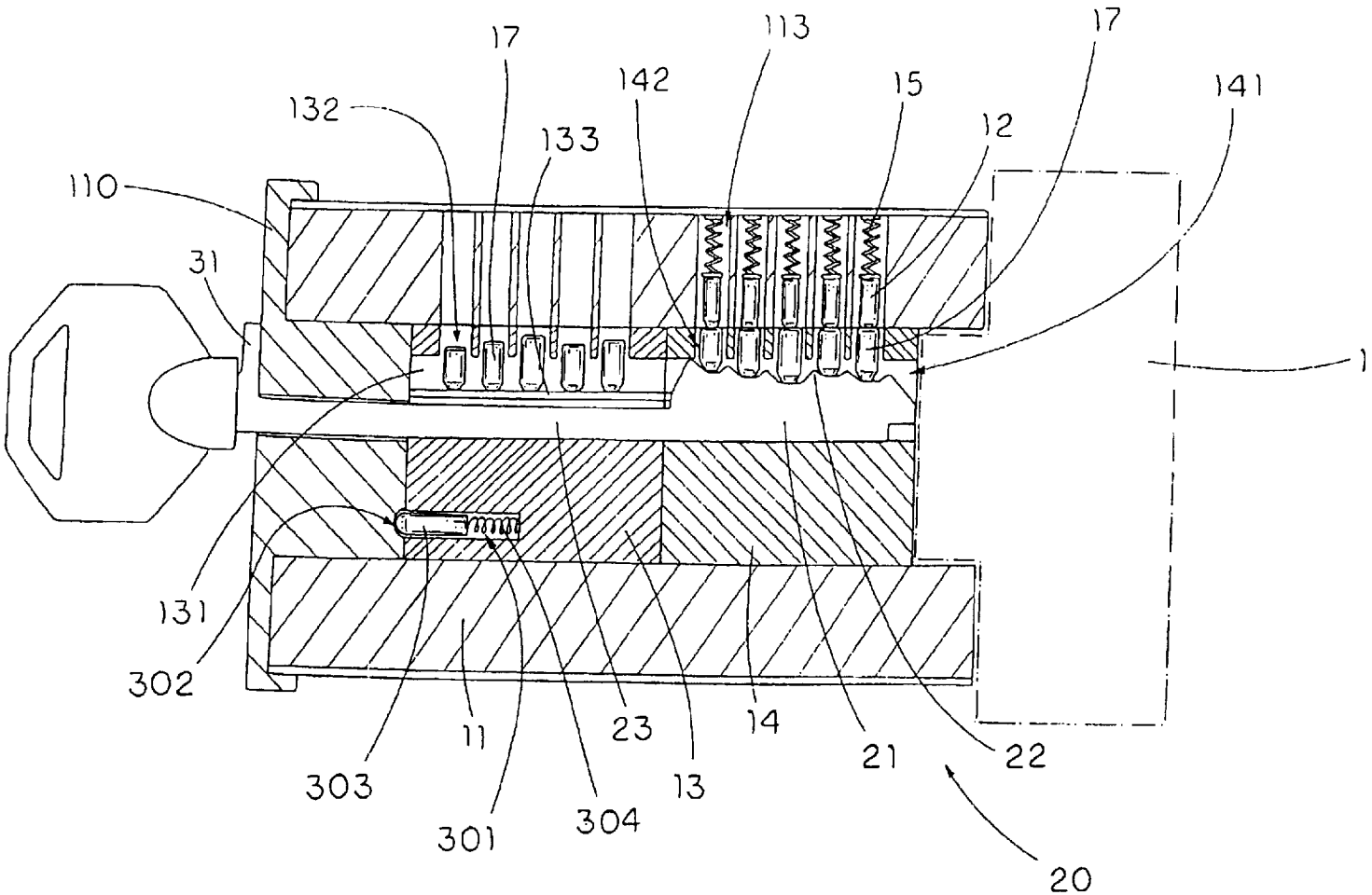
FIG. 3 is a side view of a key of the lock assembly according to the above first preferred embodiment of the present invention, illustrating the locking serrations of the key for unlocking the first and second lock rotors.

As shown in FIG. 3, the key 20 further comprises an elongated key body 23, having a size smaller than a size of the first keyway 131, rearwardly extended from the key head 21 wherein when the key head 21 is inserted into the second keyway 141, the key body 23 is positioned within the first keyway 131 in such a manner that the first lock rotor 13 is not rotated while the second lock rotor 14 is driven to rotate.

It is worth mentioning that one or more the lock pins 17 within the first lock rotor 13 can be taken out from the first locking holes 132 such that the locking combination of the lock pins 17 within the first lock rotor 13 can be randomly arranged. For example, there are five lock pins 17 disposed in the first locking holes 132 of the first lock rotor 13 respectively, as shown in FIG. 3. The locking combination of the first lock rotor 13 can be arranged by taking out two of the lock pins 17 from the first lock rotor 13 such that the locking combination of the first lock rotor 13 is different from that of the second lock rotor 14. In other words, it is impossible to find out the locking combination of the second lock rotor 14 from the locking combination of the first lock rotor 13.

Likewise, the lock pins 17 within the second lock rotor 14 can be taken out from the second locking holes 142 as well to form a locking combination different from the first lock rotor 14. Therefore, by selectively arranging the positions of the lock pins 17 within the first and second lock rotors 13, 14, the lock assembly is capable of providing hundreds of locking combinations so as to enhance the security function of the lock assembly.

Figure 4:
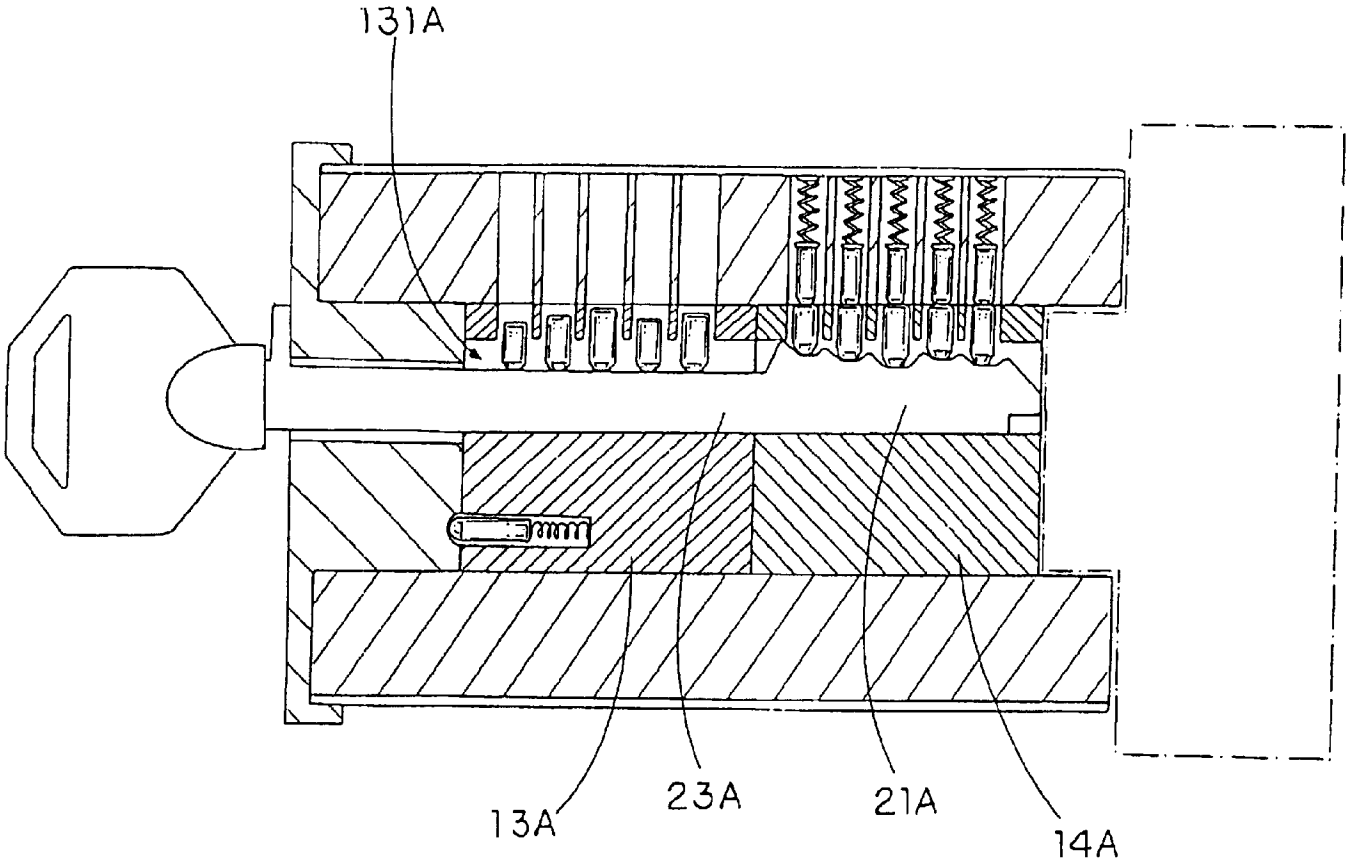
FIG. 4 illustrates a first alternative mode of the key of the lock assembly according to the above first preferred embodiment of the present invention.

As shown in FIG. 4, an alternative mode of the key 20A illustrates the key body 23A is shaped to fit in the first keyway 131A in such a manner that the first lock rotor 13A is rotated by the key body 23A correspondingly while the second lock rotor 14A is driven to rotate by the key head 21A.

Figure 5A:
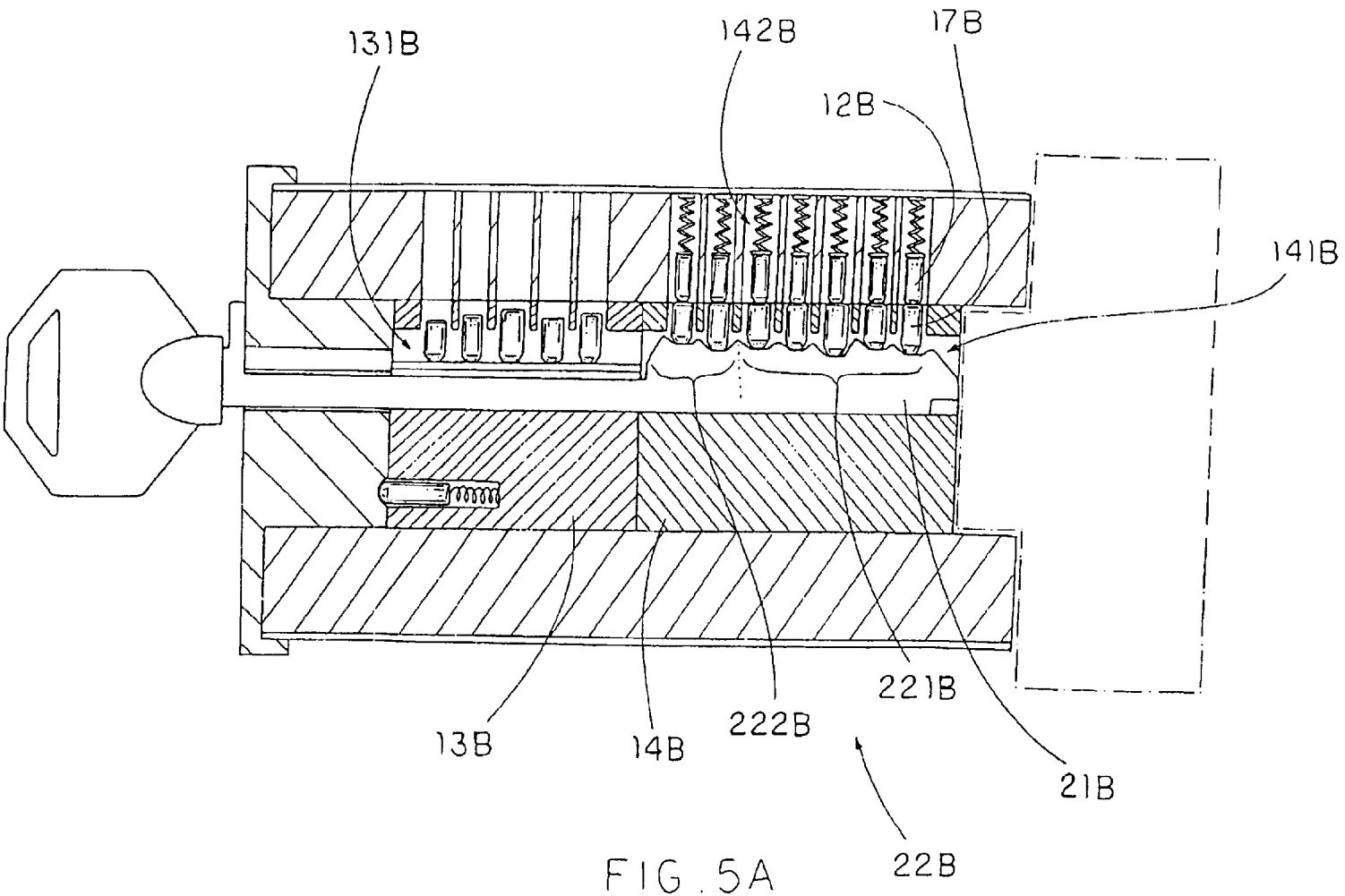
FIG. 5A illustrates a first alternative mode of the lock assembly according to the above first preferred embodiment of the present invention, illustrating the locking serrations of the key having different sections for unlocking the first and second lock rotors respectively.

As shown in FIG. 5A, another alternative of the key is illustrated, wherein the locking serrations 22B of the key head 21B has a longitudinal head serrate section 221B and a longitudinal tail serrate section 222B integrally extended therefrom, wherein the locking serrations 22B within the head serrate section 221B of the key head 21B are arranged to engage with the respective lock pins 17B to pull the respective tumblers 12B within the first locking holes 132B respectively to unlock the rotational movement of the first lock rotor 13 and the locking serrations 22B within the head and tail serrate sections 221B, 222B of the key head 21B are arranged to engage with the respective lock pins 17B to pull the respective tumblers 12B within the second locking holes 142B respectively to unlock the rotational movement of the second lock rotor 14B.

Figure 6:
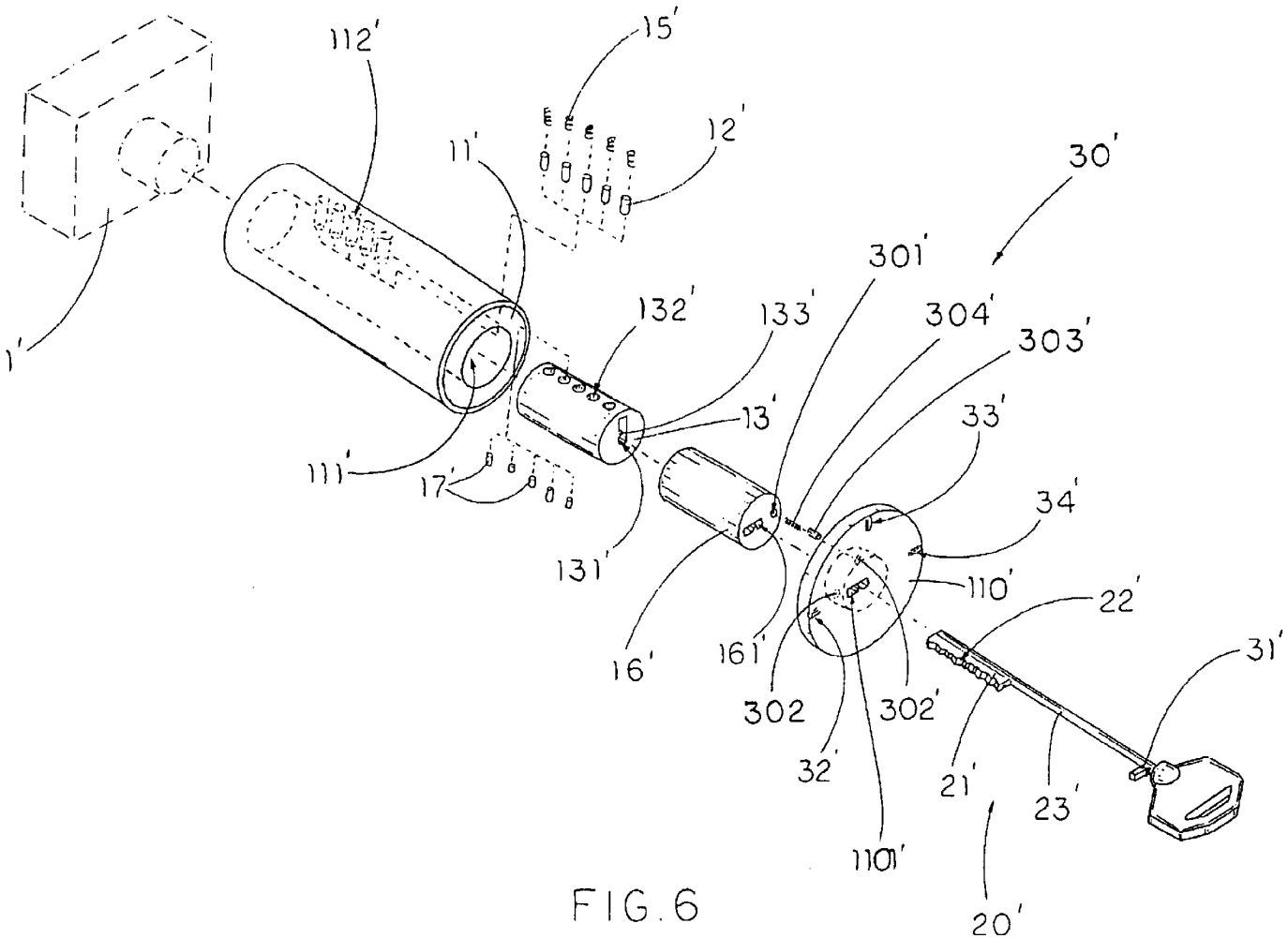
FIG. 6 is a perspective view of a lock assembly according to a second preferred embodiment of the present invention.

A length of the head serrate section 222B of the key head 21B is equal to a length of the first keyway 131B and a total length of the head and tail serrate sections 221B, 222B of the key head 21B is equal to a length of the second keyway 141B. In other words, the length of the first keyway 131B is shorter than that of the second keyway 141B. Preferably, the length of the head serrate section 221B is longer than that of the tail serrate section 222B, wherein a pattern of the locking serrations 22B within the tail serrate section 222B is repeated within a portion of the head serrate section 221B, as shown in FIG. 6. However, it is not limited that when the length of the head serrate section 221B is shorter than that of the tail serrate section 222B, wherein a pattern of the locking serrations 22B within the head serrate section 221B is repeated within a portion of the tail serrate section 222B.

Figure 5B:
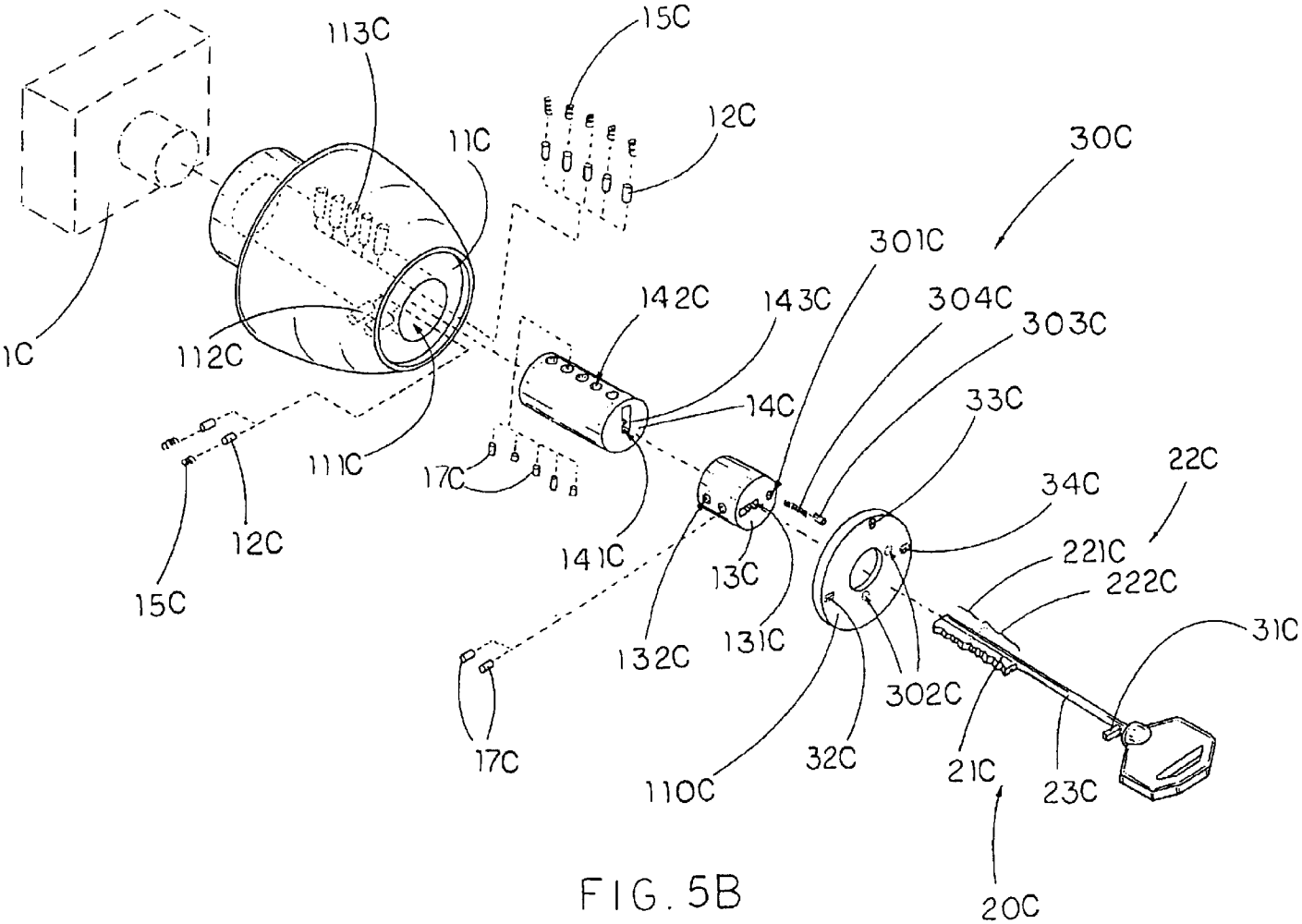
FIG. 5B illustrates a second alternative mode of the lock assembly according to the above first embodiment of the present invention.

FIG. 5B illustrates a second alternative mode of the lock assembly, wherein the length of the first lock rotor 13C is shorter than that of the second lock rotor 14C. As shown in FIG. 5B, there are two first locking holes 132C formed on the first lock rotor 13C and there are five second locking holes 142C formed on the second lock rotor 14C.

Accordingly, the locking serrations 22C within the head serrate section 221C of the key head 21C is arranged to engage with the respective lock pins 17C to pull the respective tumblers 12C within the first locking holes 132C respectively to unlock the rotational movement of the first lock rotor 13C and the locking serrations 22C within the head and tail serrate sections 221C, 222C of the key head 21C are arranged to engage with the respective lock pins 17C to pull the respective tumblers 12C within the second locking holes 142C respectively to unlock the rotational movement of the second lock rotor 14C.

Therefore, when unlocking the first lock rotor 13C, only the head serrate section 221C of the key head 21C is inserted into the first keyway 131C. However, when unlocking the second lock rotor 14C, the key head 21C must be entirely inserted into the second keyway 141C. In other words, the locking serrations 22C within the head serrate section 221C of the key head 21C is capable of not only fittedly engaging with the lock pins 17C within the first locking holes 132C respectively but also fittedly engaging with the lock pins 17C within the second locking holes 142C at a head portion of the second lock rotor 14C.

Accordingly, in order to unlock the latch assembly 1, the key 20 must be inserted into the first keyway 131 of the first lock rotor 13 until the key head 21 is pushed to reach an outer wall 140 of the second lock rotor 14. Then, the first lock rotor 13 must be rotated by the key 20 until the first keyway 131 is aligned with the second keyway 141 such that the key head 21 is capable of inserting into the second keyway 141 so as to rotate the second lock rotor 14.

As shown in FIG. 3, for ensuring the alignment between the first and second keyways 131, 141, the lock assembly further comprises a key aligning arrangement 30 having an axial receiving groove 301 provided on an outer side of the first lock rotor 13 and two alignment indentions 302 provided on an inner side of the lock cover 110. The key aligning arrangement 30 further comprises an aligning member 303, having a round head, slidably received in the axial receiving groove 301 and a compression spring 304 received in the axial receiving groove 301 for applying an urging pressure against the aligning member 303 to push the round head of the aligning member 303 to bias against the inner side of the lock cover 110 at one of the alignment indentions 302. Accordingly, the two alignment indentions 302 are formed on the lock cover 110 at positions that when the first lock rotor 13 is in an initial position and when the first lock rotor 13 is rotated to align the first keyway 131 with the second keyway 141 respectively. In other words, the aligning member 303 is biased against the lock cover 110 at the corresponding alignment indention 302 to retain the first lock rotor 13 at the initial position, and the aligning member 303 is biased against the lock cover 110 at the other alignment indention 302 to retain the first lock rotor 13 when the first keyway 131 is aligned with the second keyway 141.

As shown in FIG. 1, the key aligning arrangement 30 further comprises a protrusion 31 outwardly extended from the key 20 and first and second indicators 32, 33 provided on an outer side of the lock sleeve 110 of the lock cylinder 10, wherein when the key head 21 is inserted into the first keyway 131, the protrusion 31 on the key 20 is pointed to the first indicator 32, and when the first lock rotor 13 is rotated by the key head until the protrusion 31 is pointed to the second indicator 33, the first keyway 131 is aligned with the second keyway 141 so that the key head 21 is allowed to insert into the second keyway 131.

The key aligning arrangement 30 further comprises a third indicator 34 provided on the opening of the lock cylinder 10 and arranged in such a manner that when the second lock rotor 14 is rotated that protrusion 31 on the key 20 is moved from the second indicator 33 to the third indicator 34, the latch assembly 1 is unlocked. In other words, the first indicator 32 shows that the first and second lock rotors 13, 14 are in locked positions. The second indicator 33 shows that the first lock rotor 13 is unlocked while the second lock rotor 14 is remained in the locked position and the first and second keyways 131, 141 are aligned with each other. The third indicator 34 shows that the first and second lock rotors 13, 14 are in unlocked positions as well as the latch assembly 1 is unlocked. Therefore, the locking condition of the lock assembly can be indicated when the user turns the key 20 that the protrusion 31 is pointed at either the first, second, or third indicator 32, 33, 34.

It is worth mentioning that the lock assembly according to the first embodiment can further comprises a third lock rotor, having the same structural design of the second lock rotor, in such a manner that the key must be turn three times for aligning the first, second, third keyways with each other in order to unlock the first, second, and third lock rotors to unlock the latch assembly.

Figure 7:
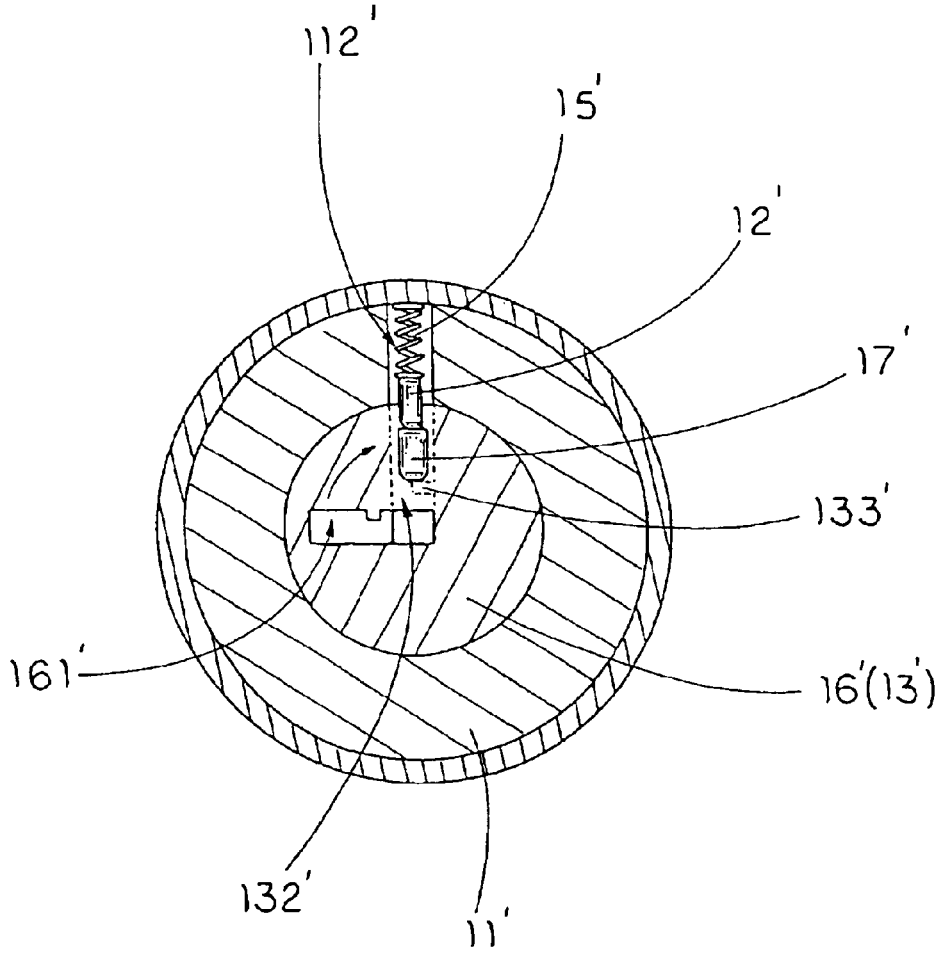
FIG. 7 is a sectional view of the lock assembly according to the above second preferred embodiment of the present invention.

As shown in FIGS. 6 and 7, a second embodiment of the lock assembly illustrates an alternative mode of the first embodiment of the present invention, wherein the lock assembly comprises a lock cylinder 10' for actuating a latch assembly 1' and a key 20'. The lock cylinder 10' comprises lock sleeve 11', a plurality of tumblers 12', a lock rotor assembly 101', a protective rotor 16', and a plurality of resilient elements 15'.

The lock sleeve 11' has an axial rotor hole 111' and a plurality of tumbler sockets 112' radially distributed on an inner surface of the lock sleeve 11'.

The tumblers 12' are coaxially placed in the tumbler sockets 112' of the lock sleeve 11' respectively, wherein each of the tumblers 12' must be equal to or shorter than the respective tumbler sockets 112' of the lock sleeve 11'.

The lock rotor assembly 101' comprises a lock rotor 13' rotatably and coaxially fitted in the axial rotor hole 111' of the lock sleeve 11' to define a keyway 131' therethrough. The lock rotor 13' has a plurality of locking holes 132' radially distributed on an outer circumferential surface of the lock rotor 13', wherein each of the locking holes 132' is capable of coaxially aligning with the tumbler sockets 112' respectively. The lock rotor assembly 101' further comprises a plurality of lock pins 17' disposed in the locking holes 132' respectively.

Accordingly, the lock rotor 13' further has a pin seat 133' provided in each of the locking holes 132' such that the lock pin 17' can only sit on the pin seats 133' within the locking holes 132' without sliding into the keyway 131' respectively.

The protective rotor 16', having a tubular shaped, is rotatably and coaxially disposed in the axial rotor hole 111' of the lock sleeve 11' at a position in front of the lock rotor 13' to define a key slot 161' therethrough wherein the key slot 161' is normally misaligned with the keyway 131' so as to block up an arrangement of the tumblers 12' within the locking holes 132' of the lock rotor 13'.

The resilient elements 15', which are compression springs according to the preferred embodiment, are coaxially disposed in the tumbler sockets 112' respectively for applying urging pressures on the tumblers 12' to move inwardly towards the locking holes 132' until an inner portion of each of the tumblers 12' is disposed in the respective locking hole 132' and an outer portion of the tumbler 12' is disposed in the respective tumbler socket 112' so as to lock up the rotational movement of the lock rotor 13' within the lock sleeve 11'.

The key 20' comprises a key head 21' having predetermined locking serrations 22' arranged in such a manner that when the key head 21' is inserted into the key slot 161', the key head 21' is adapted to drive the protective rotor 16' to freely rotate until the key slot 161' is aligned with the keyway 131', simultaneously, the key head 21' being adapted to insert into the keyway 131' such that the locking serrations 22' of the key head 21' are adapted to drive the respective lock pin 17' to pull the respective tumblers 12' moving outwardly into the tumbler sockets 112' correspondingly so as to unlock the lock rotor 13' to enable the lock rotor 13' to freely rotate to control the locking and unlocking of the latch assembly 1'.

The lock assembly further comprises a key aligning arrangement 30' having an axial receiving groove 301' provided on an outer side of the first lock rotor 13' and two alignment indentions 302' provided on an inner side of the lock cover 110'. The key aligning arrangement 30' further comprises an aligning member 303, having a round head, slidably received in the axial receiving groove 301' and a compression spring 304 received axial receiving groove 301' for applying an urging pressure against the aligning member 303' to push the round head of the aligning member 303' to bias against the lock cover 110' at one of the alignment indentions 302'.

The key aligning arrangement 30' further comprises a protrusion 31' outwardly extended from the key 20' and first, second, and third indicators 32', 33', 34' provided at an opening of the lock cylinder 10', wherein the operation of the key aligning arrangement 30' is the same as mentioned above in the first embodiment.

It is obvious that the lock rotor assembly 101' of the second embodiment can be simply substituted by the lock rotor assembly 101 of the first embodiment, wherein the protective rotor 16' must be rotated by the key head 21' until the key slot 161' is aligned with the first keyway 131 such that the key head 21' is adapted to insert into the first keyway 131 and then by aligning the first keyway 131 with the second keyway 141, the latch assembly 1' can be unlocked. In other words, the lock assembly can be simply modified to combine the first and second embodiments together so as to further enhance the security function of the lock assembly of the present invention.

Figure 8:
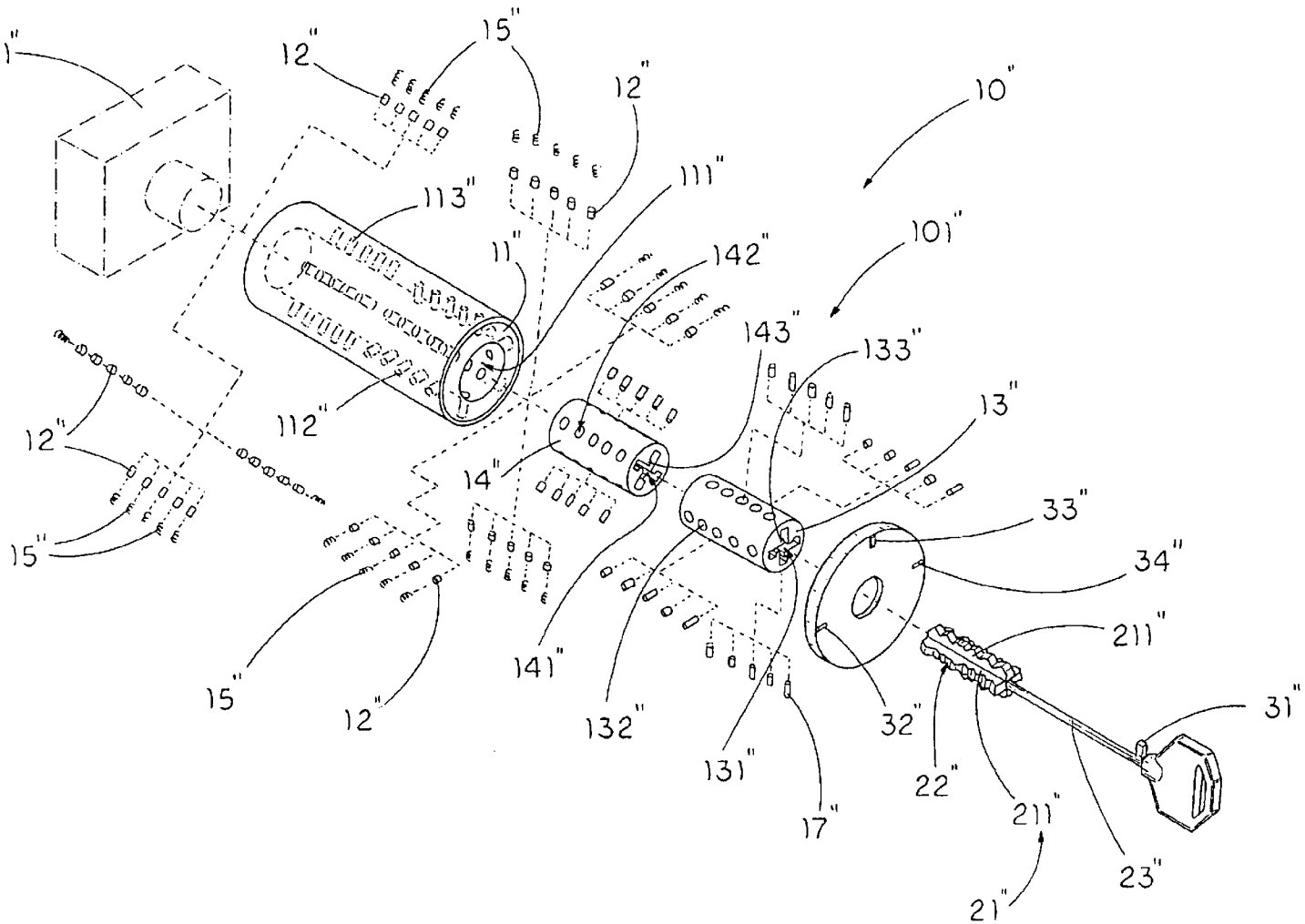
FIG. 8 is an exploded perspective view of a lock assembly according to a third preferred embodiment of the present invention.

As shown in FIG. 8, a lock assembly of a third embodiment illustrates an alternative mode of the first embodiment of the present invention, wherein the components of the third embodiment are the same as shown in the first embodiment, except the shapes of the key 20" and the first and second keyways 131", 141".

According to the third embodiment, the arrangement of the tumblers 12" is not limited to one or two opposing rows. The lock assembly can include any possible number of tumblers 12" aligned around anywhere of the entire cylindrical surfaces of the key 20" and the first and second keyways 131", 141" correspondingly, so as to provide more locking permutations and combinations to ensure the security function of the lock assembly.

The key 20" has at least two radial protrusions 211"radially extended from the key head 21" at predetermined radial directions respectively wherein the serrations 22" are formed on each radial protrusion 211'. Each of the first and second keyways 131", 141" has a corresponding cross section that the key head 21" is adapted to fittedly insert therethrough, wherein the first and second locking holes 132", 142" are selectively aligned on each radial protrusion 211" of the key head 21" in such an axial and radial positions so that the serrations 22" of the key head 21" are adapted to engage with the lock pins 17" to pull the tumblers 12" in the lock cylinder 10" in the radial directions.

Figure 9:
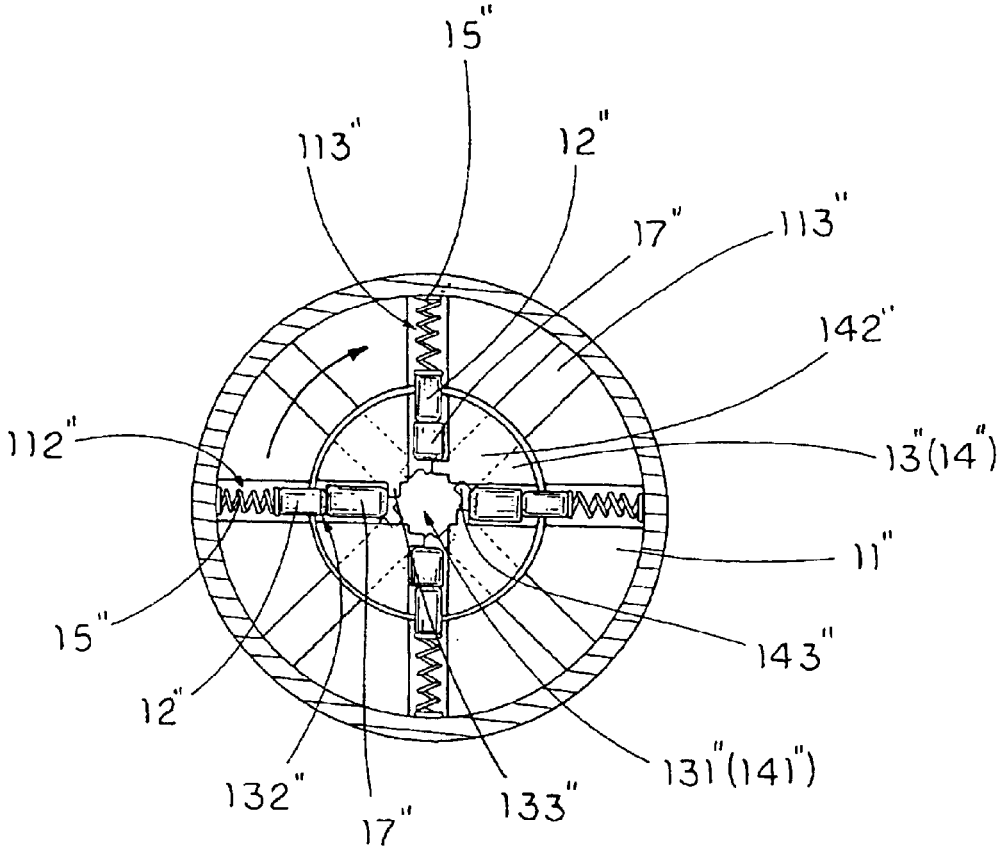
FIG. 9 is a front view of the lock assembly according to the above third preferred embodiment of the present invention.

As shown in FIGS. 8 and 9, each of the first and second keyways 131", 141"has a "cross" cross section having four radial directions wherein the first and second locking holes 132", 142" are distributed on the first and second lock rotors 13", 14" respectively along the radial directions, in such a manner that the first and second lock rotors 13", 14" are locked within the lock sleeve 11" by the tumblers 12" in four radial directions. In other the locking permutations and combinations of the lock assembly are selectively formed by the locations of the tumblers 12" to ensure the security function of the lock assembly.

The key head 21" of the key 20", having the corresponding "cross" cross sectional, has four radial protrusions 211" wherein the serrations 22" are formed on each of the radial protrusions 211" in such a manner that the key head 21" is adapted to fittedly insert into the first and second keyways 131", 141" to unlock the latch assembly 1". Accordingly, the first keyway 131" must be turned by the key head 21" to align with the second keyway 141" so that the key head 21" is allowed to insert into the second keyway 141" to unlock the latch assembly 1".

Moreover, the protective rotor 16' and the key aligning arrangement 30' of the second embodiment can be simply incorporated in the third embodiment for enhance the protection and the use of the present invention.

It is worth mentioning that the shape of the key head 21" does not limited to have four radial protrusions 211". The shape of the key head 21" can be shaped to have two radial protrusions or thee radial protrusions according to the cross section of the first and second keyways 131", 141", wherein the purpose is that the first keyway 131" must be turned to align with the second keyway 141" in order to let the key head 21" inserting into the second keyway 141". Thus, the locking permutations within the second keyway 141" is blocked by the first lock rotor 13" so that the locking permutations within the second keyway 141" cannot be seen through the first keyway 131", so as to ensure the security function of the lock assembly 1".

Therefore, the first and second keyways 131, 141, according to the first embodiment, can be embodied to have the "cross" cross section such that the firs keyway 131 must be aligned with the second keyway 141 by matching the cross sections thereof to unlock the latch assembly 1. Likewise, the key slot 161' and the keyway 131', according to the second embodiment, can be embodied to have the "cross" cross section such that the key slot 161' must be aligned with the keyway 131' by matching the cross sections thereof to unlock the latch assembly 1'. In other words, the first, second, and third embodiments can be interchanged their features and modified to further ensure the security function of the lock assembly.

While the foregoing description and figures describe the preferred embodiments and their alternative modes of the present invention, it should be appreciated that certain obvious modifications, variations, and substitutions may be made without departing from the spirit and scope of the present invention.

What is claimed is:

1. A lock assembly, comprising:

a lock cylinder for actuating a latch assembly wherein said lock cylinder comprises:

a lock sleeve having an axial rotor hole and a plurality of first and second tumbler sockets radially distributed on an inner surface of said lock sleeve;

a plurality of tumblers being coaxially placed in said first and second tumbler sockets respectively;

a lock rotor assembly, comprising:

a first lock rotor, having a tubular shaped, being rotatably and coaxially fitted in said axial rotor hole of said lock sleeve to define a first keyway therethrough, said first lock rotor having a plurality of first locking holes radially distributed on an outer circumferential surface of said first lock rotor, wherein each of said first locking holes is capable of coaxially aligning with said first tumbler sockets respectively;

a second lock rotor, having a tubular shaped, being rotatably and coaxially fitted in said axial rotor hole of the lock sleeve to define a second keyway therethrough wherein said second keyway is normally misaligned with said first keyway so as to block up an arrangement of said tumblers within said first locking holes, said second lock rotor having a plurality of second locking holes radially distributed on an outer circumferential surface of said second lock rotor, wherein each of said first locking holes is capable of coaxially aligning with said second tumbler sockets respectively;

a plurality of lock pins being disposed in said first and second locking holes respectively;

a lock cover coaxially mounted on said lock sleeve at an entrance of said axial rotor hole, wherein said lock cover has a key access slot, having a predetermined length, coaxially formed thereon, said key access slot being normally aligned with said first keyway of said first lock rotor in such a manner that said key head of said key is adapted to insert into said first keyway through said key access slot;

a key aligning arrangement for aligning said first lock rotor in an initial position normally and enabling said first lock to be rotated to align said first keyway with said second keyway; and a plurality of resilient elements being coaxially disposed in said first and second tumbler sockets respectively and applying urging pressures on said tumblers to move inwardly towards said first and second locking holes until an inner portion of each of said tumblers is disposed in said respective first and second locking hole and an outer portion of said tumbler is disposed in said respective first and second tumbler socket so as to lock up rotational movements of said first and second lock rotors within said lock sleeve; and a key comprising a key head and an elongated key body, wherein said key head comprises at least a radial protrusion radially extended from said key head at a predetermined radial direction, wherein said radial protrusion has a plurality of locking serrations arranged in such a manner that when said key head is inserted into said first keyway, wherein said key body is rearwardly extended from said key head, wherein when said key head is inserted into said second keyway, said key body is positioned within said first keyway in such a manner that when said second lock rotor is driven to rotate by said key head, said first lock rotor is remained in position, wherein said locking serrations of said key head are adapted to drive said respective lock pins to pull said respective tumblers moving outwardly into said first tumbler sockets correspondingly to unlock said first lock rotor and enable said first lock rotor freely rotating until said first keyway is aligned with said second keyway, simultaneously, said key head being adapted to insert into said second keyway such that said locking serrations of said key head are adapted to drive said respective lock pins to null said respective tumblers moving outwardly into said second tumbler sockets correspondingly so as to unlock said second lock rotor to enable said second lock rotor to freely rotate to control said locking and unlocking of said latch assembly, wherein said key aligning arrangement comprises a protrusion outwardly extended from said key and first and second indicators provided on an outer side of said lock cover, wherein when said key head is inserted into said first keyway, said protrusion on said key is pointed to said first indicator, and when said first lock rotor is rotated by said key head until said protrusion is pointed to said second indicator, said first keyway is aligned with said second keyway so that said key head is allowed to insert into said second keyway.

2. A lock assembly, comprising:

a lock cylinder for actuating a latch assembly wherein said lock cylinder comprises:

a lock sleeve having an axial rotor hole and a plurality of first and second tumbler sockets radially distributed on an inner surface of said lock sleeve;

a plurality of tumblers being coaxially placed in said first and second tumbler sockets respectively;

a lock rotor assembly, comprising:

a first lock rotor, having a tubular shaped, being rotatably and coaxially fitted in said axial rotor hole of said lock sleeve to define a first keyway therethrough, said first lock rotor having a plurality of first locking holes radially distributed on an outer circumferential surface of said first lock rotor, wherein each of said first locking holes is capable of coaxially aligning with said first tumbler sockets respectively;

a second lock rotor, having a tubular shaped, being rotatably and coaxially fitted in said axial rotor hole of the lock sleeve to define a second keyway therethrough wherein said second keyway is normally misaligned with said first keyway so as to block up an arrangement of said tumblers within said first locking holes, said second lock rotor having a plurality of second locking holes radially distributed on an outer circumferential surface of said second lock rotor, wherein each of said first locking holes is capable of coaxially aligning with said second tumbler sockets respectively;

a plurality of lock pins being disposed in said first and second locking holes respectively;

a lock cover coaxially mounted on said lock sleeve at an entrance of said axial rotor hole, wherein said lock cover has a key access slot, having a predetermined length, coaxially formed thereon, said key access slot being normally aligned with said first keyway of said first lock rotor in such a manner that said key head of said key is adapted to insert into said first keyway through said key access slot;

a key aligning arrangement for aligning said first lock rotor in an initial position normally and enabling said first lock to be rotated to align said first keyway with said second keyway; and a plurality of resilient elements being coaxially disposed in said first and second tumbler sockets respectively and applying urging pressures on said tumblers to move inwardly towards said first and second locking holes until an inner portion of each of said tumblers is disposed in said respective first and second locking hole and an outer portion of said tumbler is disposed in said respective first and second tumbler socket so as to lock up rotational movements of said first and second lock rotors within said lock sleeve; and a key comprising a key head and an elongated key body, wherein said key head comprises at least a radial protrusion radially extended from said key head at a predetermined radial direction, wherein said radial protrusion has a plurality of locking serrations arranged in such a manner that when said key head is inserted into said first keyway, wherein said key body is rearwardly extended from said key head, wherein when said key head is inserted into said second keyway, said key body is positioned within said first keyway in such a manner that when said second lock rotor is driven to rotate by said key head, said first lock rotor is remained in position, wherein said locking serrations of said key head are adapted to drive said respective lock pins to pull said respective tumblers moving outwardly into said first tumbler sockets correspondingly to unlock said first lock rotor and enable said first lock rotor freely rotating until said first keyway is aligned with said second keyway, simultaneously, said key head being adapted to insert into said second keyway such that said locking serrations of said key head are adapted to drive said respective lock pins to null said respective tumblers moving outwardly into said second tumbler sockets correspondingly so as to unlock said second lock rotor to enable said second lock rotor to freely rotate to control said locking and unlocking of said latch assembly, wherein said key aligning arrangement, which has an axial receiving groove provided on an outer side of said first lock rotor and two alignment indentions provided on an inner side of said lock cover, comprises an aligning member having a round head, slidably received in said axial receiving groove and a compression spring received in said axial receiving groove applying an urging pressure against said alignment member to gush said round head of said aligning member to bias against said inner side of said lock cover at one of said alignment indentions, wherein said alignment indentions being formed on said lock cover at positions that when said first lock rotor is in said initial position and when said first lock rotor is rotated to align said first keyway with said second keyway respectively, wherein a length of said head serrate section is longer than that of said tail serrate section, wherein a pattern of said locking serrations within said tail serrate section of said key head is repeated within a portion of said head serrate section of said key head.

3. A lock assembly, comprising:

a lock cylinder for actuating a latch assembly wherein said lock cylinder comprises:

a lock sleeve having an axial rotor hole and a plurality of first and second tumbler sockets radially distributed on an inner surface of said lock sleeve;

a plurality of tumblers being coaxially placed in said first and second tumbler sockets respectively;

a lock rotor assembly, comprising:

a first lock rotor, having a tubular shaped, being rotatably and coaxially fitted in said axial rotor hole of said lock sleeve to define a first keyway therethrough, said first lock rotor having a plurality of first locking holes radially distributed on an outer circumferential surface of said first lock rotor, wherein each of said first locking holes is capable of coaxially aligning with said first tumbler sockets respectively;

a second lock rotor, having a tubular shaped, being rotatably and coaxially filled in said axial rotor hole of the lock sleeve to define a second keyway therethrough wherein said second keyway is normally misaligned with said first keyway so as to block UP an arrangement of said tumblers within said first locking holes, said second lock rotor having a plurality of second locking holes radially distributed on an outer circumferential surface of said second lock rotor, wherein each of said first locking holes is capable of coaxially aligning with said second tumbler sockets respectively;

a plurality of lock pins being disposed in said first and second locking holes respectively;

a lock cover coaxially mounted on said lock sleeve at an entrance of said axial rotor hole, wherein said lock cover has a key access slot, having a predetermined length, coaxially formed thereon, said key access slot being normally aligned with said first keyway of said first lock rotor in such a manner that said key head of said key is adapted to insert into said first keyway through said key access slot;

a key aligning arrangement for aligning said first lock rotor in an initial position normally and enabling said first lock to be rotated to align said first keyway with said second keyway; and a plurality of resilient elements being coaxially disposed in said first and second tumbler sockets respectively and applying urging pressures on said tumblers to move inwardly towards said first and second locking holes until an inner portion of each of said tumblers is disposed in said respective first and second locking hole and an outer portion of said tumbler is disposed in said respective first and second tumbler socket so as to lock up rotational movements of said first and second lock rotors within said lock sleeve; and a key comprising a key head and an elongated key body, wherein said key head comprises at least a radial protrusion radially extended from said key head at a predetermined radial direction, wherein said radial protrusion has a plurality of locking serrations arranged in such a manner that when said key head is inserted into said first keyway, wherein said key body is rearwardly extended from said key head, wherein when said key head is inserted into said second keyway, said key body is positioned within said first keyway in such a manner that when said second lock rotor is driven to rotate by said key head, said first lock rotor is remained in position, wherein said locking serrations of said key head are adapted to drive said respective lock pins to pull said respective tumblers moving outwardly into said first tumbler sockets correspondingly to unlock said first lock rotor and enable said first lock rotor freely rotating until said first keyway is aligned with said second keyway, simultaneously, said key head being adapted to insert into said second keyway such that said locking serrations of said key head are adapted to drive said respective lock pins to pull said respective tumblers moving outwardly into said second tumbler sockets correspondingly so as to unlock said second lock rotor to enable said second lock rotor to freely rotate to control said locking and unlocking of said latch assembly, wherein said key further has at least one or more additional radial protrusions radially extended from said key head at predetermined radial directions respectively, wherein said serrations are formed on each of said radial protrusions, wherein each of said first and second keyways has a corresponding cross section that said key head is adapted to fittedly insert therethrough, wherein said first and second locking holes are selectively aligned on each of said radial protrusions of said key head in such an axial and radial positions so that said serrations of said key head are adapted to engage with said tumblers in said lock cylinder in said radial directions, wherein a length of said head serrate section is longer than that of said tail serrate section, wherein a pattern of said locking serrations within said tail serrate section of said key head is repeated within a portion of said head serrate section of said key head.

* * * * *